US006107738A

United States Patent [19]

Ullrich et al.

[11] Patent Number: 6,107,738

[45] **Date of Patent: *Aug. 22, 2000**

[54] METAL HALIDE DISCHARGE LAMP WITH IMPROVED SOCKET AND SUPPORT

[75] Inventors: Bernd Ullrich, Erlensee; Klaus Spitzenberg, Mainhausen; Michael Sander, Hamburg, all of Germany

[73] Assignee: Heraeus Noblelight GmbH, Hanau, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/007,888

[22] Filed: Jan. 15, 1998

[30] Foreign Application Priority Data

Jan. 31, 1997 [DE] Germany ..... 197 03 725

[51] Int. Cl.[7] ..... H01J 61/36

[52] U.S. Cl. ..... 313/567; 313/318.01

[58] Field of Search ..... 313/567, 118, 313/623, 113, 51, 318.01, 318.02, 25, 318.05, 318.07, 318.09, 318.12; 362/416, 263; 439/611, 182, 226, 683, 689

[56] References Cited

U.S. PATENT DOCUMENTS

| | | | |
|---|---|---|---|
| 4,533,851 | 8/1985 | Block et al. . | |
| 5,059,855 | 10/1991 | Irisawa et al. | 313/318 |
| 5,120,242 | 6/1992 | Greiler et al. | 439/683 |
| 5,220,235 | 6/1993 | Wakimizu et al. . | |
| 5,291,092 | 3/1994 | Coushaine | 313/318 |
| 5,463,270 | 10/1995 | Wakimizu et al. | 313/318.01 |
| 5,541,472 | 7/1996 | Greiler et al. | 313/318.01 |

FOREIGN PATENT DOCUMENTS

| | | |
|---|---|---|
| 0157357 | 10/1985 | European Pat. Off. . |
| 0224954 | 6/1987 | European Pat. Off. . |
| 0588201 | 3/1994 | European Pat. Off. . |
| 2661275 | 10/1991 | France . |
| 245080 | of 1987 | German Dem. Rep. . |
| 3236462 | 4/1984 | Germany . |
| 8812467 | of 1988 | Germany . |
| 9013279 | 11/1990 | Germany . |
| 9206314 | of 1992 | Germany . |
| 4112911 | of 1995 | Germany . |
| 2234628 | 2/1991 | United Kingdom . |

*Primary Examiner*—Nimeshkumar D. Patel
*Assistant Examiner*—Matthew Gerike
*Attorney, Agent, or Firm*—Fulbright & Jaworski, LLP

[57] ABSTRACT

An optical emitter is provided, in particular for ultraviolet or infrared radiation, with a lamp bulb (1) from which extend at least two connecting wires (4, 5) for electrical connection, in each case through a stem press (2, 3) at the upper end and the lower end of the lamp bulb (1). The first connecting wire (4) is electrically connected with a first contact pin (15) via a flexurally rigid holding bracket (6), and the second connecting wire (5) is electrically connected with a second contact pin (16) via a metallic contact element (7). The contact pins (15, 16) each extend out from a bore of a ceramic base (10). To provide an improved optical emitter which can be manufactured with lower expenditures of time and cost, the holding bracket (6) and the first connecting pin (15) are designed in one piece and the first contact pin (15) is provided with an anti-slip safety on both sides of the first bore in the base (10).

10 Claims, 3 Drawing Sheets

METAL HALIDE DISCHARGE LAMP WITH IMPROVED SOCKET AND SUPPORT

FIELD OF THE INVENTION

The invention relates to an optical emitter, in particular for ultraviolet or infrared radiation, with a lamp bulb from which at least two connecting wires, are each extended through a stem press at the upper and the lower end of the bulb for electrical connection, where the first connecting wire is electrically connected by a flexurally rigid holder with a first contact pin and the second connecting wire is electrically connected with a second contact pin through a metallic contact element where the contact pins each extend from a bore of a ceramic base.

The invention relates to optical emitters as are used for example as heat radiators or UV radiators for browning, disinfection, surface treatment or for drying and curing of thin layers. Relatively high temperatures are generated due to the high power outputs of UV or IR emitters so that the inherent heat expansion and temperature loads play an important role in the construction design and selection of material for the emitters. Optical emitters for visible light, operated at low power, are not subject of the invention.

DESCRIPTION OF THE PRIOR ART

An optical emitter of the kind described in the preamble is known from DE A1 32 36 462. Described therein is a high pressure discharge lamp with a base on one side and two opposed electrodes inside a lamp bulb. The bulb is sealed vacuum-tight by stem presses on both side and the contact wires for the electrical connection of the electrodes are extended out through the stem presses.

The lamp bulb is mounted by cementing of one of the lower stem presses into the base. The portion of the base facing the bulb will be hereinafter referred to as the upper base part, and the opposite part as the lower base part.

On the outer side of the stem presses the contact wires are linked by electrical connectors to sockets which are riveted in the lower part of the base and extend from there in a direction away from the bulb as closed hollow contact pins. The contact pins provide the electrical connection when the discharge lamp is inserted into an appropriate fixture. Their diameter is commonly about 3 mm or about 2 mm.

Electrical power is supplied to the electrode located opposite the base by a flexurally rigid and stiff copper band in form of a bow extending past the lamp bulb. The copper band is connected to the electrode contact wire on the one hand and to one of the hollow sockets on the other hand. Moreover, the copper band is cemented in the base.

The contact wire on the side facing the base is connected to the second socket by an angle-shaped metal part. The metal part is also cemented into the upper part of the base.

To prevent the cement mass in the upper part of the base from negatively affecting the electrical contacts in the lower part, the two base areas are usually spatially separated by means of an inserted mica washer.

Numerous welded connections must be made for the electrical connection in the known discharge lamp. The cementing of the bulb and of the electrical contact parts such as the bow-shaped copper band and the metal part, are costly and require great care. In addition, a relatively high base is common in the known discharge lamp to assure a stable mounting of the cemented parts, in particular of the lamp bulb, as well as for an operationally secure hold of the contacts and components for the electrical connection.

Manufacture of the known discharge lamp is therefore costly in terms of time and money.

SUMMARY OF THE INVENTION

The object of the invention is to provide an optical emitter in which cementing can be dispensed with and which can be manufactured with relatively low expenditures of time and money. According to the invention, this object is achieved based on the emitter described in the introduction by designing the holding bracket and the first contact pin as a single piece and by providing the first contact pin with an anti-slide safety on both sides of the first base bore.

In the optical emitter according to the invention the holding bracket and one of the contact pins extending from the base are designed as one piece. At the same time, the contact pin is provided with a safety on both sides of the base bore, preventing a slide-through. This construction assures that two of the essential functions of the bracket are fulfilled, i.e., supplying power to the emitter on one hand and holding the lamp bulb on the other, while at the same time keeping assembly outlay low. This is explained below in more detail.

The holding bracket fulfills its power supply function by electrically connecting the first connecting wire of the electrode to the first contact pin. Since the holding bracket and the contact pin are configured as a single piece, no welding or soldering is necessary to provide the electrical connection. The contact pin does not need to be configured as a hollow part either, as is the case for example in the contact pin known from prior art.

The holding bracket fulfills its holding function by being flexurally rigid and by being joined with the base on the one hand and with the upper end of the lamp bulb on the other. The attachment to the base is based on the single-piece construction of the holding bracket and the contact pin and on the non-slip attachment of the contact pin at the base. The holding of the lamp bulb is thus completely or substantially assumed by the holding bracket. Cementing of the lamp bulb and of the holding bracket can be therefore dispensed with. This simplifies the manufacture of the emitter and moreover allows the use of a smaller base which, in the most simple case, can even be configured as a plate provided with two through bores. However, the latter is merely an additional advantage of the invention which need not be realized.

Therefore the creation of the necessary electrical and mechanical connections in the emitter according to the invention requires only a relatively small outlay.

The holding bracket exhibits sufficient flexural rigidity according to the invention if its mechanical stability assures feasible handling and operational safety of the emitter without necessitating cementing of the bulb in the base.

The non-slip safety is to be understood as a suitable design of the contact pin, or of a component gripping the contact pin, so that a complete slipping of the contact pin through the base bore is prevented. This does not exclude a play of the contact pin within the bore, and play could be even desirable to compensate for thermal expansion.

One embodiment of the emitter according to the invention in particular has proven itself, where the contact element and the second contact pin are designed as a single piece and where the second contact pin is provided with an anti-slip safety on both sides of the base bore. In this embodiment the lamp bulb is held between the holding bracket and the contact element. As far as the contact element attachment is concerned, the above explanation regarding the holding bracket attachment applies correspondingly. Cementing can be dispensed with, soldering or welding work to provide electrical connections is not needed. The lamp bulb can be even held completely outside of the base by the holding bracket and the contact element. In such case the connections between the lamp bulb are easily accessible so that costly welding and soldering work within the base area are not required.

The contact element is frequently designed as an angle element. Since its legs are shorter than the holding bracket, lesser material thickness is sufficient to provide adequate rigidity. When wire is used for the angle element, wire thickness is usually greater than 1 mm, preferably about 2 mm.

Clamping components or material deformations have been shown to be particularly suitable forms of the anti-slip safety. Such clamping components are preferably provided on the lower side of the base. They can be for example releasable clamping washers or spring elements. Such clamping elements can be provided at the opposite side of the bores as well, but there a slip safety in form of material deformation has been successful. For example, the contact pin can have a bend, a kink or a thickening of material, or it can be provided with a pinch whose lateral measurement exceeds that of the bore.

Especially preferred is assembly of an emitter in which the holding bracket and contact element design employ round wire with a constant diameter. Here the wire diameters correspond to the diameters of the respective contact pins.

It has also been shown to be advantageous in this respect to provide the holding bracket and the contact element with groove-shaped recesses which are arranged in line and parallel to the longitudinal axis of the lamp bulb and into which the connecting wires are welded or soldered. In this embodiment of the emitter, the lamp bulb with its connecting wires extending out from the stem press only needs to be placed into the groove-shaped recess and subsequently soldered or welded in, by for example spot welding.

A holding bracket has been successful with an average cross section surface of at least 3 $mm^2$—seen in the direction of its longitudinal axis—in that section which is important for its flexural rigidity. The rigidity of the bracket is determined, beside the material employed, by the surface resistance acting against flexing. The section which is important for flexural rigidity of the holding bracket is that section which is commonly subjected to bending loads during handling of the emitter, such as during insertion into a fixture and during manufacture. It is not necessary for the bracket to have the same cross section surface over its entire length. What is important is that the cross section surface be sufficiently great in every segment of its length to assure adequately stable handling and a safe operation of the emitter. The average cross section surface of a plate-shaped holding bracket with a right-angle cross section—as seen in the direction of its longitudinal axis—corresponds to the right angle surface averaged over the section relevant for flexural rigidity. In case of a holding bracket made of wire the average cross section surface is calculated from the average wire diameter in the section relevant for flexural rigidity. Preferably, the average cross section surface of the holding bracket is about 7 $mm^2$, especially for holding brackets made of wire. This corresponds to a wire thickness of about 3 mm.

Advantageously, at least the holding bracket or at least the contact element are fastened joined to the base with play. This allows to compensate for changes of the lamp bulb length during its operation. Sufficient play is provided if one of the contact elements has an axial play of less then one millimeter, or even if a one of the respective contact element is tiltable. The terms "axial movability" and "tilt" refer here to the direction defined by the longitudinal axis of the lamp bulb. Sufficient play can even be provided by for example a base bore that is greater by a small gap than the diameter of the respective pin.

The assembly of the emitter is facilitated if the base is provided with at least two opposite side bores through which the contact element and the lower, second connecting wire are accessible. A contact element that is already fixed in the base can be joined to the lower connecting wire by for example resistance welding through the provided bores located opposite to one another in the side walls of the base. They do not need to be encompassed by a closed edge. The bores can also be configured in the base as notches open on one side.

Handling and manufacture of the emitter according to the invention is additionally simplified if the holding bracket is combined with a handle. One grips the known discharge lamp at the upper bulb stem press in order to establish electrical connection and to insert it into a fixture. The holding bracket can be used for this in the emitter according to the invention, thus preventing soiling or damage to the lamp bulb. A handle connected with the holding bracket facilitates this even more. For this purpose the handle is commonly located in the area of the upper part of the lamp bulb. It can be designed as an integral component of the holding bracket.

BRIEF DESCRIPTION OF THE DRAWINGS

Examples of the invention are shown in the drawings and are explained in more detail below. The drawings show schematically in FIG. 1, a side view of the first: embodiment of a discharge lamp with a one-sided base according to the invention, in FIG. 2, a side view of another embodiment of a discharge lamp with a one-sided base according to the invention, in a partially sectional drawing, in FIG. 3, a side view of a base with installed contact pins and holding bracket, and in FIG. 4, a top view of the device shown in FIG. 3, along the line A—A.

DETAILED DESCRIPTION

Figure 1:
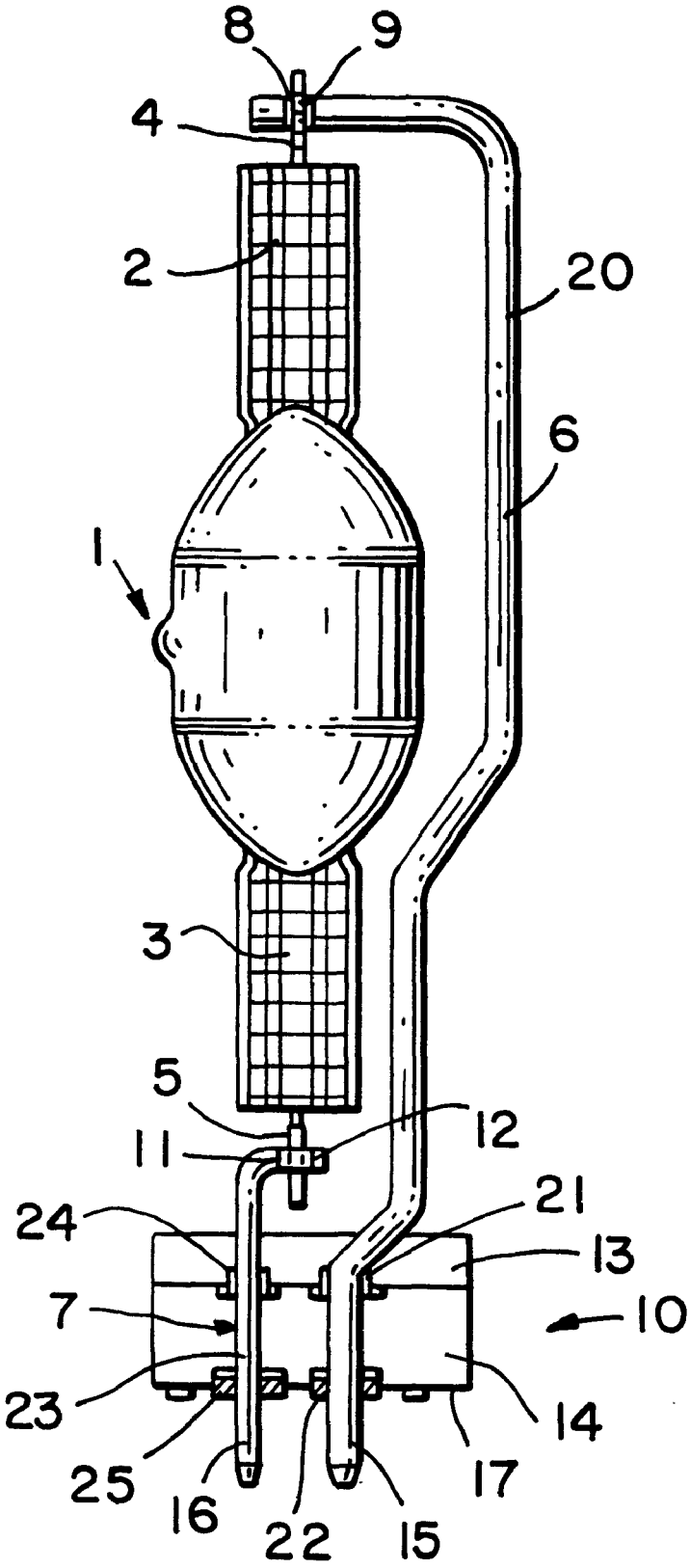

In FIG. 1, reference 1 of the discharge lamp designates the lamp bulb which is sealed vacuum-tight by an upper stem press 2 and a lower stem press 3. The connecting wires 4, 5 for the electrical connection of the discharge lamp electrodes (not shown) extend out from the stem presses 2, 3.

Lamp bulb 1 is held between holding bracket 6 and holding angle 7. In order to fix the lamp bulb 1, the holding bracket 6 is provided with a groove 8 into which the upper connecting wire 4 is inserted and joined with the holding bracket 6 by spot welding indicated as hatched area 9. Holding bracket 6 is made of round stiff metal wire with a diameter of 3.2 mm. It extends from the upper connecting wire 4 along lamp bulb 1 to a ceramic base 10 with which it is joined.

Holding angle 7 is made of stiff round metal wire with a diameter of 1.8 mm. A groove 11 is provided in the short leg of the holding angle 7 for the attachment of the lamp bulb 1 to the holding angle into which groove the lower connecting wire 5 is inserted and fixed to the holding angle by spot welding, indicated by hatched area 12. The long leg 23 of the holding angle 7 is fixed to the base 10.

The lamp bulb 1 is held only by the holding bracket 6 and the holding angle 7 in the base 10; cementing is not necessary. Further, electrical connection is also provided by the holding bracket 6 and the holding angle 7 This is explained in more detail below.

The ceramic base 10 comprises the U-shaped upper part 13 which is open on top. The upper base part 13 is fixed to a solid lower part 14. There are provided in the lower base part 14 through bores through which extend the contact pins 15, 16 for the electrical connection of the discharge lamp to a suitable fixture. The first contact pin (15) and the holding bracket (6) are constructed in one piece, as are, likewise, the holding angle 7 and the contact pin 16. The first contact pins 15 or 16 are each of the same diameter, as are the holding bracket 6 or the holding angle 7.

The holding bracket 6 extends between both legs of the "U" which is open on top, then through and out of one of the bores of the base 10 from its lower part 17 as the contact pin 15 on the side opposite lamp bulb 1. The connection between the base and the holding bracket 6 or connecting pin 15 is effected by a small enlargement of the holding bracket 6 in the area of the upper base part 13 and above the bore, which prevents the holding bracket 6 from slipping downward through the bore. Below the bore, a lock washer 22 grips the contact pin 15 and prevents the contact pin 15 from slipping through upward. The lock washer is installed in such a manner that a small amount of axial play of the contact pin 15 or of the holding bracket 6 is allowed in a direction parallel to their longitudinal axes 20. The axial play compensates for thermal expansion during operation of lamp bulb 1; however, slipping through of the contact pin 15 or of the holding angle 6 is prevented.

The long leg 23 of the holding angle 6 extends between both arms of the upwardly open "U" through a bore in base 10 and extends as the contact pin 16 out from the lower part 17 of the base 10 on the side opposite the lamp bulb. The joining between base 10 and holding angle 7 or contact pin 16 is accomplished analogously to holding bracket 6 by a corresponding enlargement 24 in the area of the upper base part 13 and by the lock washer 25 which attacks below the bore and prevents an upward movement of the contact pin 16. Please refer to the preceding explanation. In contrast to the attachment of holding bracket 6, however, the lock washer 25 is firmly fixed so that the holding bracket 7 is held in the bore without any play.

Thus, only two spot welds 9, 12 are necessary for the electrical connection of the lamp bulb 1. The locations of spot welds 9, 12 lie outside of the base and are therefore easily accessible. The spot welds 9, 12 simultaneously serve to provide a hold of the lamp bulb 1 in base 13 and this hold is completed by joining in a simple fashion holding bracket 6 or holding angle 7 and the base 13. Therefore there are only a few simple manufacturing steps required to establish the necessary electrical connections of the discharge lamp and for the holding of the lamp bulb 1. In comparison to the known discharge lamp, the base is notable for small height. This contributes to material savings and permits a more compact design of the discharge lamp according to the invention.

Figure 2:
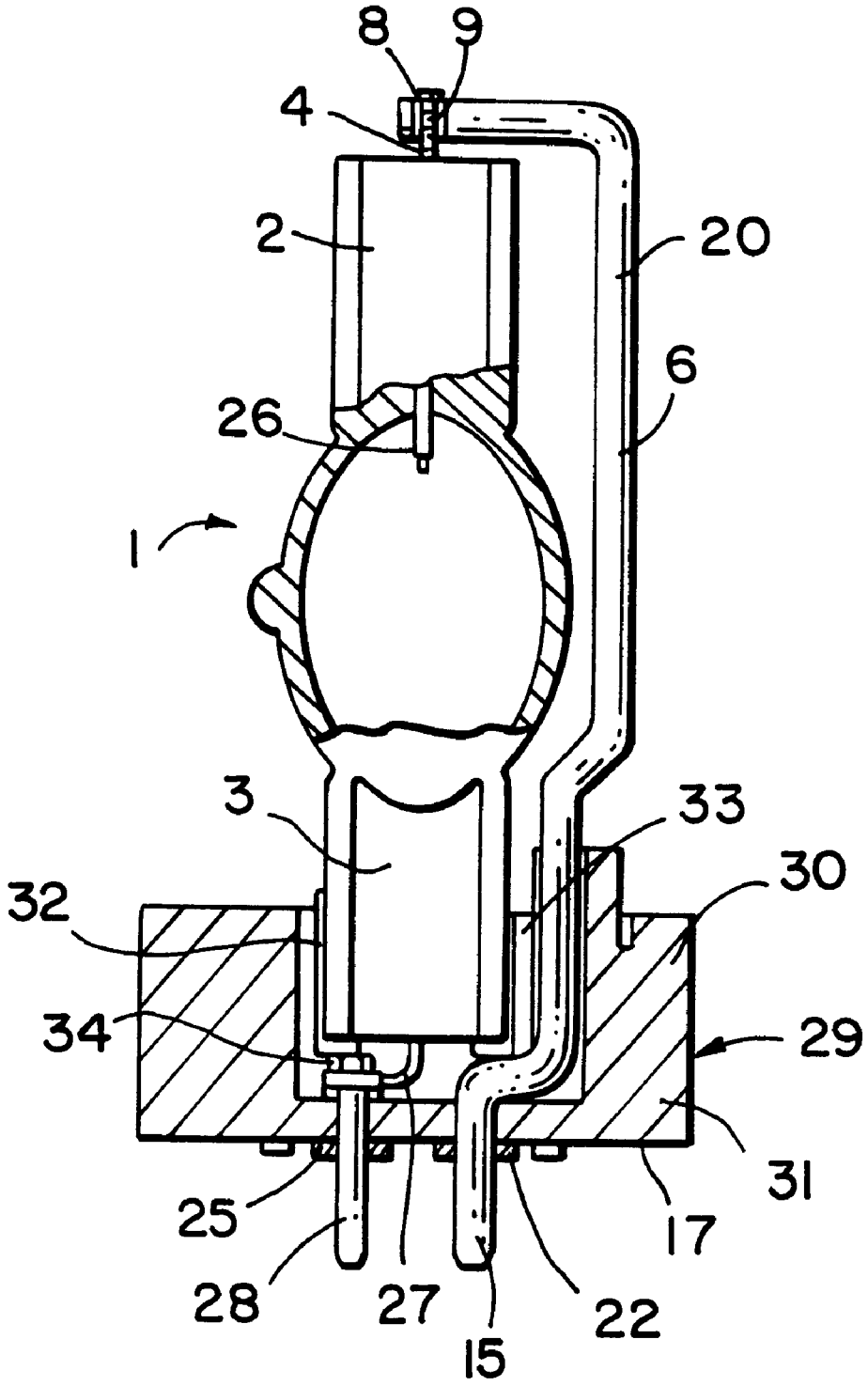

Insofar as in FIG. 2 the depiction of an additional embodiment of the discharge lamp according to the invention employs the same reference numbers as in FIG. 1, wherein the reference numbers refer to the similar components or parts of the discharge lamp as referenced in regard to FIG. 1.

Reference 1 of the discharge lamp shown in FIG. 2 is assigned to a lamp bulb which is sealed vacuum-tight by means of an upper stem press 2 and a lower stem press 3. The electrical connection of the electrode 26 extends from the stem press 2 as the connecting wire 4. The electrical connection for the opposite electrode (not shown) is accomplished via the connecting wire 27.

The lamp bulb 1 is held between the holding bracket 6 and a contact pin 28. The manner of the attachment of lamp bulb 1 corresponds to the embodiment shown in FIG. 1. The holding bracket 6 is made of flexurally rigid round metal wire with a diameter of 3.2 mm. It extends from the upper connecting wire 4 along the lamp bulb 1 to the ceramic base 29 to which it is fixed and from which it extends as the contact pin 15. Holding bracket 6 and contact pin 15 are manufactured from one piece. The contact pin 15 has the same diameter as the holding bracket 6.

The one-piece ceramic base 29 comprises an upper part 30 and a lower part 31. The upper base part 30 is provided with a recess 32 which is open on the upper side and into which recess the lower stem press 3 of the lamp bulb 1 partially extends. The holding bracket 6 extends in a side cut 33 of the recess 32, initially along stem press 3. In the area below the stem press 3 it extends in an S-shaped horizontal bend, as the contact pin 15, from the through bore in the lower base part 31. The holding bracket 6 has a recess in its lower part in the vicinity of the S-bend so that it is prevented from slipping through the bore. In other respects, the attachment of base 29 to the holding bracket 6 by means of a lock washer 22 corresponds to the explanation of the embodiment in FIG. 1.

An additional bore is provided in the lower base part 31, through which extends contact pin 28. Contact pin 28 is directly fixed to connecting wire 27 by means of a spot weld. The connection between base 29 and contact pin 28 is accomplished, as in the case of the holding bracket 6, by the appropriate enlargement which is created here by a spot weld 34 in the area of the upper base part 13 and by a lock washer 25 which grips underneath the bore and prevents the contact pin 16 from slipping through upward. Refer to the explanation above. The lock washer 25 is firmly affixed so that contact pin 28 is held firmly in the bore without play.

The lamp bulb 1 is held in the base 10 primarily by the holding bracket 6; cementing is not necessary. In addition, the holding bracket 6 provides the electrical connection of the lamp bulb 1. Thus only two spot welds 9, 34 are needed for the electrical connection of lamp bulb 1. A more compact construction of the discharge lamp is achieved due to the fact that the lower stem press 3 partially extends into the base.

Figure 3:
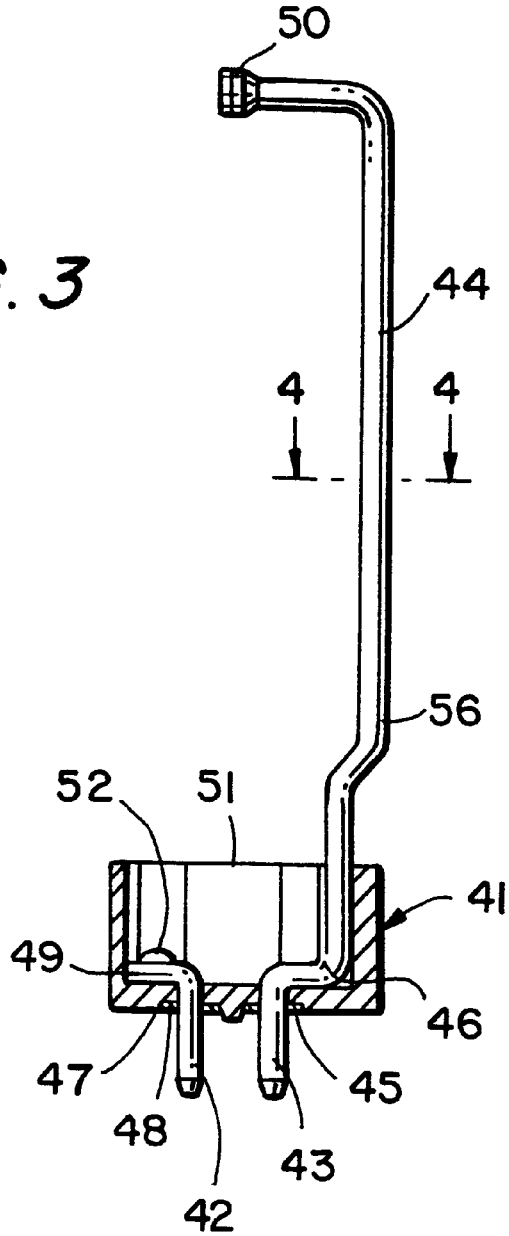

The simple assembly of the emitter according to the invention is also shown more clearly in FIG. 3 through an embodiment where contact pins 42 or 43 are pre-installed in the base. The contact pin 43 which also serves as holding bracket 44 for the lamp bulb (not shown), is held in the base 41 by means of a clip 45 on the one hand and by a bend 46 inside the base 41 on the other hand. Clip 45 and bend 46 prevent contact pin 43 or holding bracket 44 from slipping through the bore in base 41. In the same manner, contact pin 42 which is formed into an angle piece, is secured by means of a clip 48 provided on the lower base part 47 and by the bent leg 49 of the angle piece on the upper side of the base bore.

Figure 4:
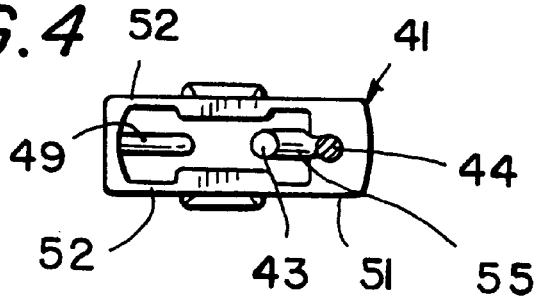

For an installation of a lamp bulb in the base it is then merely required to join the connecting wires for electrical connection with the holding bracket 44 and the contact pin 42. A groove 50 is provided for this in the holding bracket 44, into which groove the upper connecting wire is welded by means of resistance welding. In the same manner, the lower connecting wire is welded into a groove (not shown) of the contact pin 42. For this, both long side walls 51 of the base 41 are provided with apertures 52, through which apertures connecting wire and connecting pin 42 are fixed and welded together. Apertures 52 in the side walls 51 of the base 41 are more clearly visible in the top view shown in FIG. 4.

What is claimed is:

1. An optical emitter comprising:

a lamp bulb having upper and lower ends each having a stem press and a metallic contact element;

at least two connecting wires each ex(tending through a respective stem press at the upper and the lower end of the bulb to provide for electrical connection;

the first connecting wire being electrically connected by a rigid holding bracket with a first contact pin; and the second connecting wire being electrically connected with a second contact pin through said metallic contact element;

a ceramic base having bores therein;

the contact pins each extending through a respective bore in the ceramic base;

the right holding bracket and the first contact pin being formed integral with each other as a single piece; and the first contact pin being provided with a retaining structure on each side of the associated bore, said retaining structure preventing slip of said contact pin through the bore in the ceramic base.

2. An optical emitter according to claim 1 further comprising a retaining structure, wherein the contact element and the second contact pin are formed as one integral piece, and the second contact pin being provided with said retaining structure on each side of the associated bore, said retaining structure preventing slip of said contact pin through the bore in the ceramic base.

3. An optical emitter according to claim 1, wherein the retaining structure is a clamp element or a material deformation structure.

4. An optical emitter according to claim 1, wherein the holding bracket and the contact element are each formed of round wire having a constant diameter.

5. An optical emitter according to claim 1, wherein the holding bracket and the contact element each have therein a recess therein aligned with each other and parallel to a longitudinal axis of the bulb, and the contact-wires being welded or soldered into said recesses.

6. An optical emitter according to claim 1, wherein, adjacent the bulb, the holding bracket has a cross section area of at least 3 $mm^2$.

7. An optical emitter according to claim 1 wherein the holding bracket is supported in the respective bore in the base so as to permit limited movement relative thereto.

8. An optical emitter according to claim 1 wherein the contact element is supported in the respective bore in the base so as to permit limited movement relative thereto.

9. An optical emitter according to claim 1, wherein the base has at least two side bores located opposite to each other through which the contact element and a second contact wire are accessible.

10. An optical emitter according to claim 1 and further comprising a handle, wherein the holding bracket is provided with a handle.

* * * * *